US011385573B1

(12) United States Patent
Butler et al.

(10) Patent No.: US 11,385,573 B1
(45) Date of Patent: Jul. 12, 2022

(54) END CAPS AND FILMS

(71) Applicant: Hewlett-Packard Development Company, L.P., Spring, TX (US)

(72) Inventors: Blair A Butler, San Diego, CA (US); James Huai Kiang, San Diego, CA (US); Stanley J Kozmiski, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/322,081

(22) Filed: May 17, 2021

(51) Int. Cl.

| | |
|---|---|
| ***G03G 15/10*** | (2006.01) |
| ***G03G 21/16*** | (2006.01) |
| ***G03G 15/11*** | (2006.01) |
| ***G03G 15/00*** | (2006.01) |

(52) U.S. Cl.
CPC ..... *G03G 15/11* (2013.01); *G03G 15/10* (2013.01); *G03G 15/751* (2013.01); *G03G 21/1647* (2013.01)

(58) Field of Classification Search
CPC ..... G03G 15/10; G03G 15/11; G03G 15/751; G03G 21/1647; G03G 21/1676; G03G 2215/00987
See application file for complete search history.

(56) References Cited

U.S. PATENT DOCUMENTS

| | | | | |
|---|---|---|---|---|
| 8,426,514 | B2 | 4/2013 | Yuan | |
| 10,294,363 | B2 | 5/2019 | Guzman | |
| 2005/0281580 | A1* | 12/2005 | Lewis | G03G 15/086 399/109 |
| 2008/0138546 | A1 | 6/2008 | Soria | |
| 2009/0028750 | A1* | 1/2009 | Ryan | A61L 2/18 422/28 |
| 2012/0301188 | A1* | 11/2012 | Yamabe | G03G 15/0865 399/262 |
| 2018/0329336 | A1* | 11/2018 | Butler | G03G 15/11 |

FOREIGN PATENT DOCUMENTS

| | | |
|---|---|---|
| WO | WO-2016066232 | 5/2016 |
| WO | WO-2017182054 | 10/2017 |
| WO | WO-2018006956 | 1/2018 |

* cited by examiner

*Primary Examiner* — Sophia S Chen
(74) *Attorney, Agent, or Firm* — Brooks Cameron & Huebsch PLLC

(57) ABSTRACT

Examples include an end cap system for a developer unit in a liquid photographic printer. The end cap system includes an end cap and a film that includes a first outermost superficial layer and a second outermost superficial layer opposed to the first outermost superficial layer. The first outermost superficial layer is a pressure sensitive adhesive layer applied to a portion of an inner surface of the end cap. The second outermost superficial layer is a low surface energy layer to be exposed to liquid photographic printing fluid during printing.

20 Claims, 4 Drawing Sheets

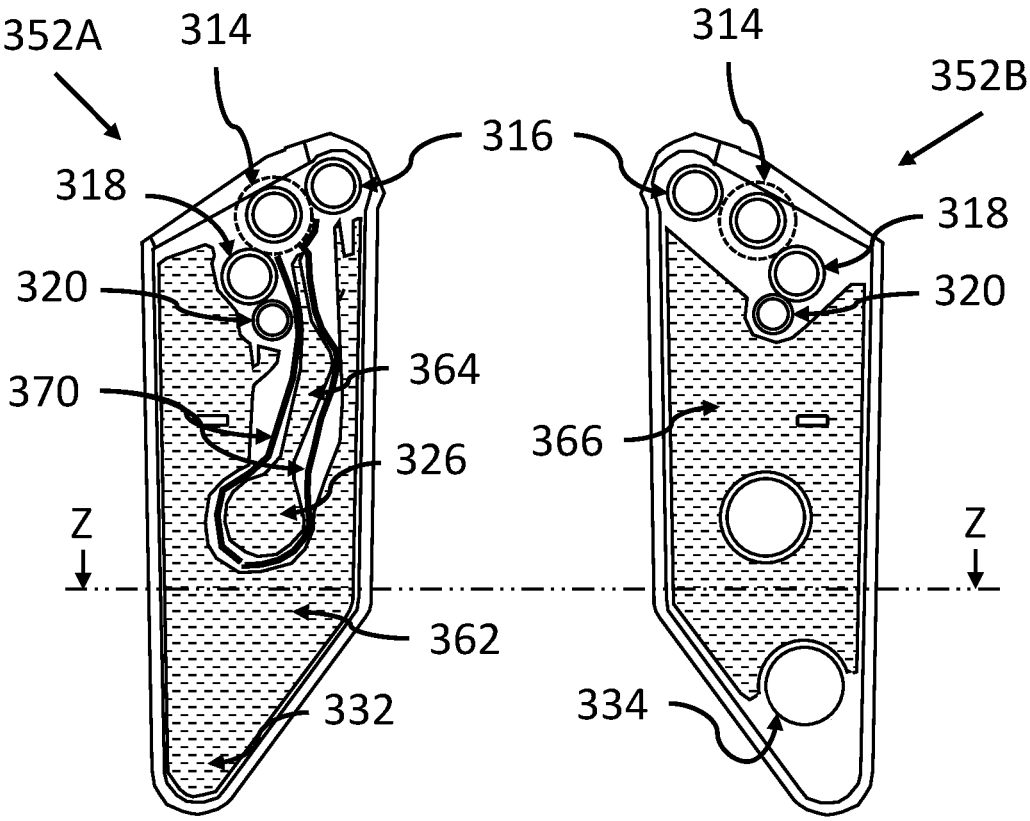
Fig. 3A
Fig. 3B
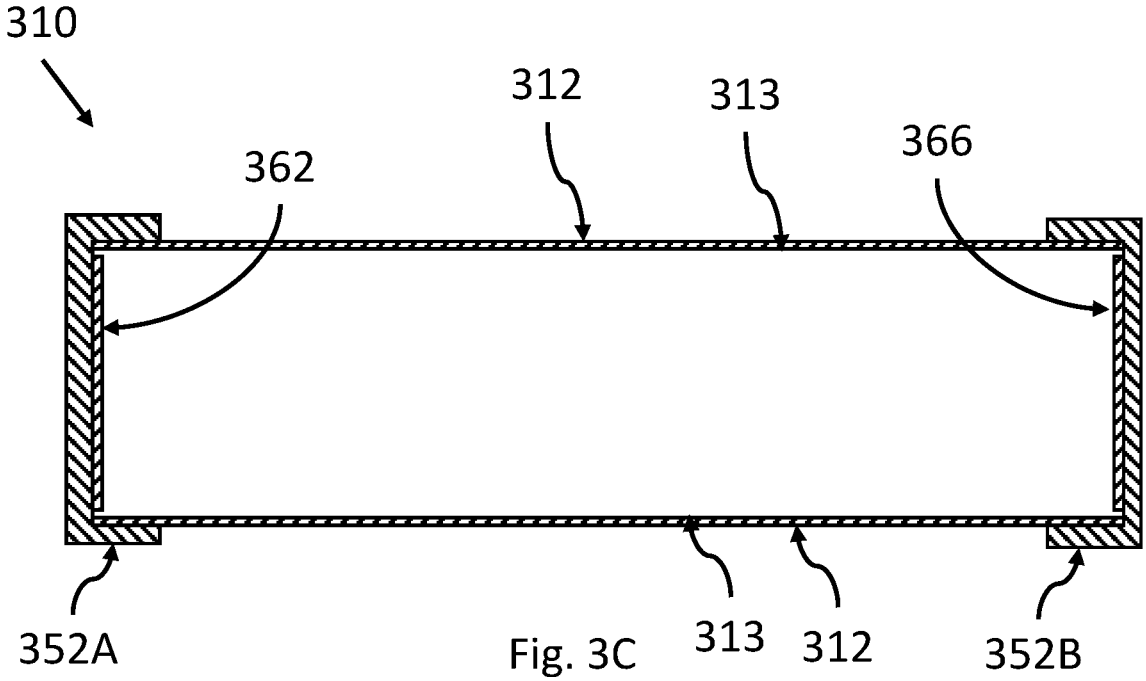
Fig. 3C

END CAPS AND FILMS

BACKGROUND

Liquid electrophotographic (LEP) printing uses a special kind of printing fluid to form images on paper and other print substrates. LEP printing fluid usually includes charged polymer particles dispersed in a carrier liquid. The polymer particles are sometimes referred to as toner particles and, accordingly, LEP printing fluid is sometimes called liquid toner. LEP printing fluid may also include a charge control agent to help control the magnitude and polarity of charge on the particles. An LEP printing process involves placing an electrostatic pattern of the desired printed image on a photoconductor and developing the image by presenting a thin layer of LEP printing fluid to the charged photoconductor. The printing fluid may be presented to the photoconductor with a roller that is commonly referred to as a "developer roller." Charged toner particles in the printing fluid adhere to the pattern of the desired image on the photoconductor. The printing fluid image is transferred from the photoconductor to a print substrate, for example through a heated intermediate transfer member that evaporates much of the carrier liquid to dry the printing fluid film, and then to the print substrate as it passes through a nip between the intermediate transfer member and a pressure roller.

BRIEF DESCRIPTION OF THE DRAWINGS

FIGS. 3A-C illustrate an example developer unit.

DETAILED DESCRIPTION

In liquid electrophotographic printing, a thin film of LEP printing fluid is applied to the exterior of a developer roller and then presented to a photoconductor at a nip between the developer roller and the photoconductor. A squeegee roller rotates against the developer roller to squeegee excess carrier liquid from the printing fluid film before the printing fluid is presented to the photoconductor. A cleaner roller rotates against the developer roller to remove residual printing fluid after printing fluid has been transferred to the photoconductor. The ends of each roller are sealed between end caps of a developer unit to help prevent printing fluid leaking away from the rollers. A developer unit comprises the end caps, the rollers and electrodes. The electrodes causes charged particles in the LEP printing fluid to adhere to the developer roller by electrostatically applying a thin layer of printing fluid to the surface of the developer roller along the electrodes as the developer roller is rotating. A voltage difference between the developer roller and the electrodes causes the charged particles in the LEP printing fluid to adhere to the developer roller. While the end caps can be attached to each other to form an enclosure of the developer unit, the developer unit can comprise a housing or tray as a transition piece supporting the end caps. During operation of the LEP printer, the developer unit contains printing fluid. The end caps have an inner surface facing the inside of the developer unit, the inner surface being exposed to the printing fluid during operation of the developer unit. Components of the printing fluid may accumulate onto such inner surface, sometimes leading to a build-up of solid components of the printing fluid. Such an accumulation can have an impact on the composition of the printing fluid, for example when a significant quantity of such accumulated solid components gets suddenly released from the inner surface into the developer unit, potentially leading to printing color instability. Preventing such accumulation reduces the risk of clumps of printing fluid solids falling off and potentially clogging a drain. Such an accumulation may also render cleaning of an end cap difficult, for example when such an end cap should be recycled. Avoiding or limiting such accumulation and facilitating cleaning of an end cap forms the foundation of the present disclosure. This is obtained as described in the present disclosure by applying a film, for example a film comprising both a pressure sensitive adhesive layer and a low surface energy layer, such film reducing accumulation of printing fluid components due to the low surface energy layer, and such film being peelable from the end cap due to the pressure sensitive adhesive layer, leading to easing the cleaning and recycling of end caps equipped with the film.

Figure 1A:
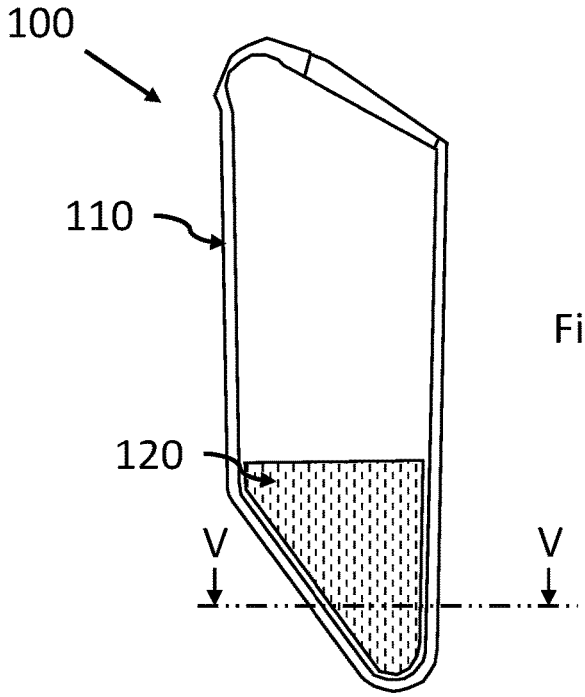
FIGS. 1A-B illustrate an example end cap.

FIG. 1A illustrates an example end cap system 100 for a developer unit in a LEP printer. An end cap should be understood as a mechanical piece for supporting the ends of shafts of rollers. An end cap may comprise a support surface supporting the end of shafts of the rollers, and end cap sides projecting from the support surface along a direction of the roller axis. In some examples, the end caps are made of a plastic material. In some examples, the end caps comprise cavities, sockets or through holes permitting supporting the shaft ends of the rollers.

The end cap system 100 comprises an end cap 110 and a film 120. A film should be understood as a thin, flexible, planar structure. In some examples, the film has a thickness of less than 0.5 mm, of less than 0.2 mm, of less than 0.1 mm or of less than 0.09 mm. In some examples, the film has a thickness of more than 0.05 mm, of more than 0.06 mm, or of more than 0.07 mm.

Figure 1B:
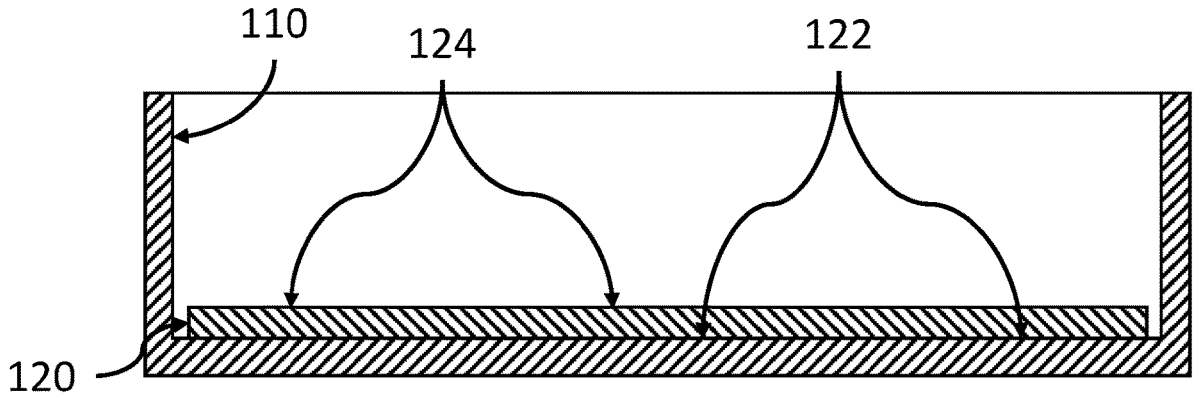

FIG. 1B illustrates the system 100 illustrated in FIG. 1A, seen along the plane V illustrated in FIG. 1A. FIG. 1B is at a different scale from FIG. 1A for purposes of clarity. The thickness of film 120 as illustrated in FIG. 1B was increased compared to the thickness of end cap 110 for the purpose of clarifying the illustration. The film 120 comprises a first outermost superficial layer 122 and a second outermost superficial layer 124 opposed to the first outermost superficial layer. A superficial layer should be understood as a layer of the film which extends itself across the film along dimensions normal to a direction of thickness of the film. Such extension may take place across the entire film, or across a portion of the entire film. An outermost superficial layer should be understood as a superficial layer which defines a superficial end of the film and is not covered by an additional layer of the film. In some examples, the first and second outermost superficial layers face each other. In some examples, the first and second outermost superficial layers both extend across the entire film. In some examples, one or both of the first and second outermost superficial layers extend across a portion of the entire film, in some examples across a different portion of the entire film.

The first outermost superficial layer is a pressure sensitive adhesive layer applied to a portion of an inner surface of the end cap. The inner surface of the end cap should be understood as the surface of the end cap oriented towards the inside of the developer unit. In some examples, such inner surface of the end cap is generally concave in order to contribute to containment of the printing fluid within the developer unit. Part or all of the inner surface of the end cap may be exposed to printing fluid when the LEP printer is operating. The pressure sensitive adhesive layer is applied to a portion of an inner surface of the end cap. Being applied should be understood in that the pressure sensitive adhesive layer is directly in contact with the portion of the inner surface of the end cap. The portion of the inner surface of the end cap may be a genus zero surface, i.e. a surface without a hole. The portion of the inner surface may be a genus non-zero surface, i.e. a surface comprising a hole or a plurality of holes, for example to accommodate components of the developer unit such as a roller shaft end, a printing fluid inlet, a printing fluid outlet, an alignment feature, a connector or a sensor, in which cases the film may comprises a cutout. In some examples, cutouts are provided which permit utilizing a same film with different endcaps having different features, configurations or components. The portion of the inner surface may comprise a single area of the inner surface, in which case the film comprises a single film section. The portion of the inner surface may comprise different separate areas of the inner surface, in which case the film comprises more than one film section. The configuration of the portion of the inner surface to which the pressure sensitive layer is applied may be configured and adapted to maintain the functionality of the end cap during operation of the printer, for example by ensuring that some areas of the inner surface of the end cap remain uncovered by the film, for example to permit rotation of a roller, to permit passage of printing fluid, of data, of power or of mechanical connections or to permit sealing a seal directly against the inner surface of the end cap. In some examples, the configuration of the portion of the inner surface to which the pressure sensitive layer is applied may be configured and adapted to focus on specific areas more likely to be exposed to printing fluid accumulation over time. In some examples, the inner surface of the portion of the end cap to which the pressure sensitive layer is applied corresponds to at least 10% of an entire inner surface of the end cap, in some examples at least 30%, in some examples at least 50%, in some examples at least 70% of an entire inner surface of the respective end cap. In some examples, the inner surface of the end cap comprises an intricate edge, for example an edge corresponding to an acute angle between sides projecting from the support surface, whereby the intricate edge is uncovered by the film in order to avoid difficulty when adhering the film or when removing the film, in particular by avoiding film breakoff during removal.

A pressure sensitive adhesive layer should be understood as a layer which adheres to the inner surface of the end cap while being peelable from such inner surface. In some examples, the pressure sensitive adhesive layer has a peel strength of 100 gf/25 mm or more at room temperature, at a peel rate of 5 mm/sec and a peel angle of 180 degrees. The pressure sensitive adhesive layer may comprise an acrylic polymer having a weight average molecular weight (Mw) of between 400,000 and 2,500,000. The weight average molecular weight is a conversion value to standard polystyrene that is measured by gel permeation chromatography (GPC). The pressure sensitive adhesive layer may include an epoxy acrylate, or a polyester acrylate, or a polyether acrylate. The pressure sensitive adhesive layer may comprise an epoxy-functional acrylic polymer.

The second outermost superficial layer is a low surface energy layer to be exposed to liquid photographic printing fluid during printing. A low surface energy layer should be understood as a layer which renders bonding difficult. In some examples, a low surface energy layer has a surface energy below 0.036 N/m. Example low surface energy layers may include polyolefin plastics such as polypropylene and polyethylene as well as "non-stick" surfaces such as polytetrafluorethylene (PTFE) or fluorinated polyurethane polymers. The low surface energy layer may include a polyol composition comprising a hydroxyl terminated polyester and/or a hydroxyl terminated polyether and a hydroxyl terminated polysiloxane. In some examples, the low surface energy layer comprises a silicone polymer. In some examples, the silicone polymer is the cross-linked product of a silicone oil and a cross-linker component. In some examples, the silicone polymer is the cross-linked product of a silicone oil, a cross-linker component and a cross-linking catalyst. In some examples, the silicone polymer is a polysiloxane that has been cross-linked using an addition cure process such that it contains Si—X—Si bonds, where X is an alkylene moiety. In some examples, the silicone polymer comprises the cross-linked addition cured product of: at least one silicone oil having alkene groups linked to the silicone chain of the silicone oil; a cross-linker comprising a silicone hydride component; and, in some examples, an addition cure cross-linking catalyst. In some examples, the silicone polymer comprises the cross-linked condensation cured product of at least one silicone oil, a condensation cure cross-linker component, and a condensation cure cross-linking catalyst. In some examples, the silicone polymer comprises the UV or IR radiation cross-linked cured product of at least one silicone oil, a photo cross-linker, and a photo-initiator. In some examples, the silicone polymer comprises the activated cross-linked cured product of at least one silicone oil, a cross-linker comprising a peroxide component, and an activated cure cross-linking catalyst. The low surface energy layer may comprise a silicone polyurethane polymer.

Figure 2A:
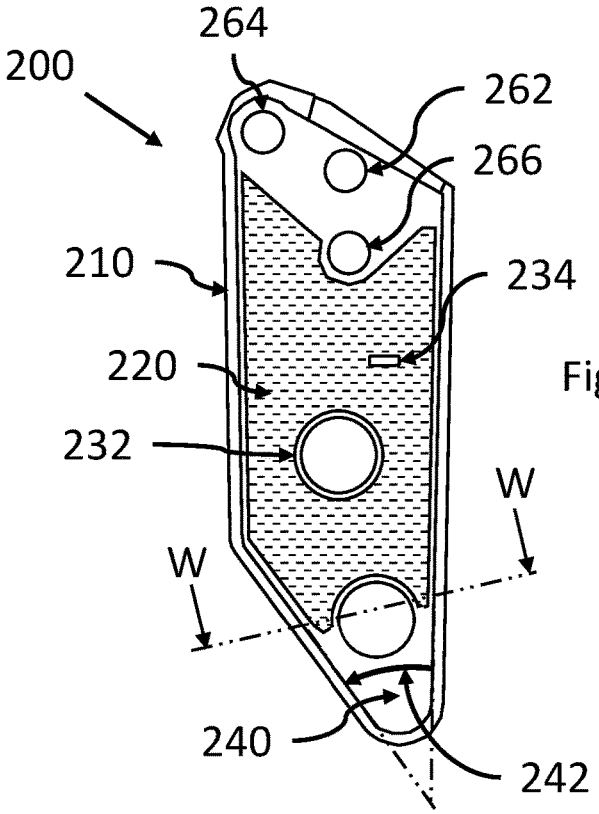
FIGS. 2A-B illustrate another example end cap.
Figure 2B:
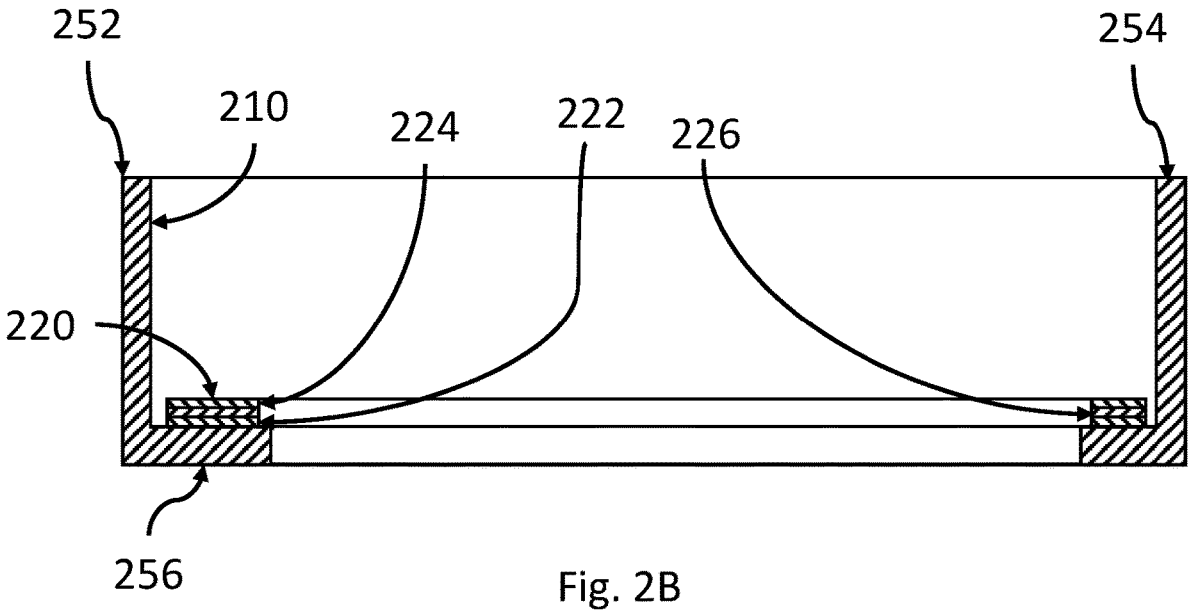

FIG. 2A represents illustrates another example end cap system 200 for a developer unit in a LEP printer. FIG. 2B represents a view of the system 200 taken along the plane W illustrated in FIG. 2A.

The end cap system 200 comprises an end cap 210 and a film 220. The scales and proportions are adapted to render visible different layers of the film 220 in FIG. 2B. In this example, the film 220 comprises a substrate layer 226 between the first outermost superficial layer 222 and the second outermost superficial layer 224 opposed to the first outermost superficial layer.

In this example film 220, the substrate layer comprises a polyethylene terephthalate polymer, the low surface energy layer comprises a silicone polymer, and the pressure sensitive adhesive layer comprises an epoxy-functional acrylic polymer. This example film structure was found suitable for use for example in combination with and resistant to a printing fluid comprising carrier liquid including aliphatic hydrocarbons, isoparaffinic compounds, paraffinic compounds, dearomatized hydrocarbon compounds, and the like. In particular, such carrier liquids can include Isopar-G™, Isopar-H™, Isopar-L™, Isopar-M™, Isopar-K™, Isopar-V™ Norpar 12™, Norpar 13 ™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™). It was indeed found that the composition of film 220 was resistant to such carrier liquids.

Film examples may comprise a substrate or substrates between the first and the second outermost layers. A substrate may comprise a single layer, or multiple layers. A substrate may comprise substrate material suitable to be coated on one side by a pressure-sensitive adhesive layer, and on the other side by a low surface energy layer. The substrate layer may comprise a polyethylene terephthalate, a polytetrafluoroethylene, a polyethylene, a polypropylene, a polybutene, a polybutadiene, a vinyl chloride copolymer, a polyurethane, an ethylene-vinyl acetate, an ethylene-propylene copolymer, an ethylene-ethyl acrylate copolymer, an ethylene-methyl acrylate copolymer or a polyimide. The substrate layer may comprise a polyethylene terephthalate polymer.

In this example, the film 220 comprises a single film section and cutouts 232 and 234. In this example cutout 232 is for a printing fluid inlet and cutout 234 is for a specific feature of the end cap, in this case an alignment feature. In this example, the film 220 has two cutouts and thereby corresponds to a genus two surface. In some examples such as this one, the cutout of the film is slightly larger than the feature or element for which the cutout is provided, in order to facilitate placement of the film, by introducing an offset distance whereby the inner surface of the end cap remains without film coverage and directly exposed to printing fluid in an area corresponding to this offset. Such offset distance may for example be of more than 0.5 mm, more than 1 mm, more than 2 mm or more than 3 mm. In this example, the inner surface of the end cap comprises an intricate edge 240, the intricate edge being in this case contained within an acute angle 242 of less than 45 degree between end cap sides, or end cap side walls, 252 and 254 projecting from end cap support surface 256. such intricate edge is left uncovered by the film in order to facilitate applying the film.

In this example, end cap system 200 comprises a top section comprising sockets 262, 264 and 266 which permit lodging and supporting, respectively, a developer roller, a squeegee roller, and a cleaner roller of a developer unit. The top section should be understood as a section which is oriented towards the top when the end cap is in operation, the printing fluid being primarily located in an opposite bottom section by gravity.

FIGS. 3A-3C illustrate an example developer unit 310, represented schematically in a cross section view as illustrated in FIG. 3C taken along a plane parallel to plane Z illustrated in FIGS. 3A and 3B. Developer unit 310 includes a housing 312 housing a developer roller 314 (the circumference of which is represented in dashed lines), a squeegee roller 316, a cleaner roller 318, and a sponge roller 320. Each end of each roller is in this example associated to respective seals illustrated by a circle concentrical to the respective rollers at the point at which their shaft intersects an end cap. Developer roller 314 is to present a layer of printing fluid to a photoconductor (not illustrated here), the developer roller being rotatable on a shaft. Printing fluid may be pumped to a local supply chamber 326 in developer unit 310 from an external reservoir through an inlet. Also, excess printing fluid may be reclaimed and collected in a local return chamber 332 and returned to reservoir through an outlet 334. In operation, according to one example, supply chamber 326 is pressurized to force printing fluid up through a channel to the electrically charged developer roller 314. A thin layer of printing fluid is applied electrically to the surface of the rotating developer roller 314 along electrodes 370. A voltage difference between developer roller 314 and the electrodes causes charged particles in the printing fluid to adhere to roller 314. Squeegee roller 316, to squeegee printing fluid on the developer roller at an upstream nip between the developer roller and the squeegee roller, the squeegee roller being rotatable on a shaft, rotates along developer roller 314 to squeegee excess carrier liquid from the printing fluid on roller 314 while charged particles in the printing fluid continue to adhere developer roller 314.

The now more concentrated printing fluid on developer roller 314 is presented to the photoconductor where some of the printing fluid is transferred in the pattern of a latent electrostatic image on the photoconductor at a nip between roller 314 and the photoconductor, as a desired image. A charged cleaner roller 318, to clean printing fluid from the developer roller at a downstream nip between the developer roller and the cleaner roller, the cleaner roller being rotatable on a shaft, rotates along developer roller 314 to electrically remove residual printing fluid from roller 314. In this example, cleaner roller 318 is scrubbed with a so-called "sponge" roller 320 that is rotated against cleaner roller 318. Some of the printing fluid residue may be absorbed into sponge roller 320 and some may fall away. Excess carrier liquid and printing fluid drains to return chamber 332, where it can be recycled to a reservoir.

Developer unit 310 also includes end caps 352A, 352B attached to housing 312 to support each roller 314-320 on its respective shaft, for example within supporting sockets such as sockets 262-266 as illustrated in the case of end cap 200 of FIG. 2A. Such end caps are represented attached to housing 312 in FIG. 3C to form the developer unit 310, and represented separately from the housing 312 in FIGS. 3A and 3B to illustrate their inner surface exposed to printing fluid during operation.

Developer unit 310 also includes seals compressed between each end cap and each end of the squeegee roller, of the cleaner roller and of the developer roller. An example roller sealing system includes seals to help prevent printing fluid from leaking off circular outer surfaces past the ends of the rollers.

Developer unit 310 further comprises films 362, 364 and 366, each such film comprising a pressure sensitive adhesive layer applied to a portion of an inner surface of each end cap, the films further comprising a low surface energy layer to be exposed to liquid photographic printing fluid during printing. In this example, the portion of the inner surface of the end caps to which the pressure sensitive adhesive layer is applied is separate from a part of the inner surface of the end caps against which the seals are compressed, such part of the inner surface of the end caps against which the seals are compressed corresponding to a top section of the end caps for supporting the rollers. Such separation between the portion of the inner surface of the end caps to which the pressure sensitive adhesive layer is applied and the part of the inner surface of the end caps against which the seals are compressed permits avoiding that a film interferes with the sealing of the seals directly against the inner surface while benefiting from the effect of films 362, 364 and 366 on the areas which they are covering.

In the example of developer unit 310, the housing 312, to which the end caps are attached, comprises an inner surface 313 of the housing 312, such inner surface 313 of the housing 312 comprising a sprayed low surface energy additive. Such sprayed low surface energy additive permits avoiding accumulation of printing fluid on such a surface. It was found that combining on one hand a sprayed low surface energy additive on the inner surface of the housing and on the other hand a film according to this disclosure on the inner surface of the end caps resulted in reducing printing fluid accumulation and in facilitating cleaning. The sprayed low surface energy additive may have a composition as hereby described for the low surface energy layers.

In the example of developer unit 310, the developer unit comprises a top section comprising the rollers and a bottom section to collect printing fluid, whereby the portions of the inner surface of each end cap to which the films are applied correspond to the bottom section, which is more prone to printing fluid accumulation than the top section, due to the effect of gravity.

In the example of developer unit 310, the developer unit comprises electrodes 370, the films comprising a film section 364 located between the electrodes, such film section permitting avoiding printing fluid accumulation during operation, cleaning of end caps in this specific intricate area, and recycling of end caps. In this examples, the developer unit comprises two end caps, one end cap comprising a single film 366, the other end cap comprising a pair of films 362 and 364, the pair of films comprising a first film 364 surrounded by the electrodes, and a second film 362 surrounding the electrodes, thereby permitting obtaining the desired effect of the films without impacting the effect of the electrodes.

In the example of developer unit 310, the films 362, 364 and 366 may each have a structure and composition as, for example, any of the films hereby described, including film 220 or film 120.

Figure 4:
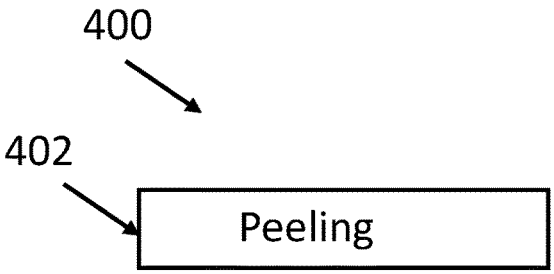
FIG. 4 illustrates an example method.

FIG. 4 illustrates an example method 400 for recycling a used developer unit, such as, for example, developer unit 310, of a liquid photographic printer; the method 400 comprising, in block 402, peeling a first soiled film off a portion of an inner surface of a first end cap of the developer unit, the first soiled film being soiled with printing fluid. Such peeling is facilitated for example by employing a film comprising a pressure sensitive adhesive layer as hereby described, revealing a clean inner surface which was protected from soiling by the film as the film is peeled off the inner surface.

Figure 5:
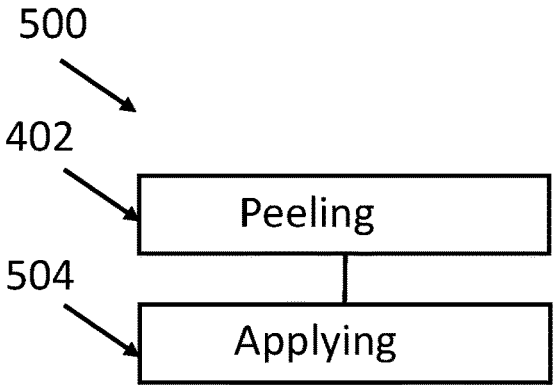
FIG. 5 illustrates another example method.

FIG. 5 illustrates an example method 500 comprising block 402 as described in the context of FIG. 4, as well as block 504 of applying a first clean film onto the portion of the inner surface of the first end cap in response to having peeled the first soiled film off as per block 402. This permits preparing such first end cap for being protected in view of being reused.

Figure 6:
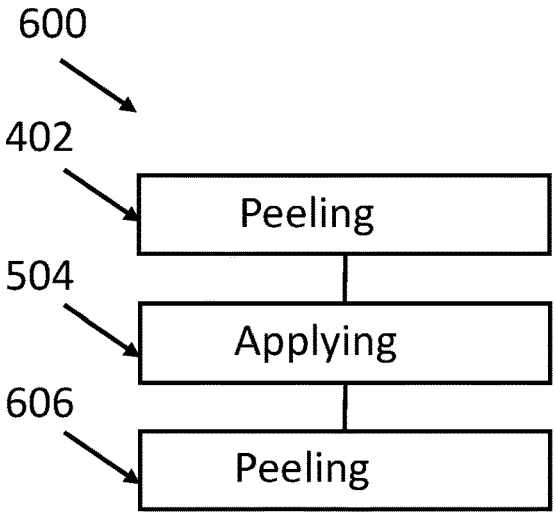
FIG. 6 illustrates a further example method.

FIG. 6 illustrates an example method 600 comprising block 402 as described in the context of FIG. 4, block 504 as described in the context of FIG. 5, as well as block 606 of peeling a second soiled film off a portion of an inner surface of a second end cap of the developer unit, the second soiled film being soiled with printing fluid. It should be noted that block 606 may take place prior to, concurrently to or following any of blocks 402 and 504.

Figure 7:
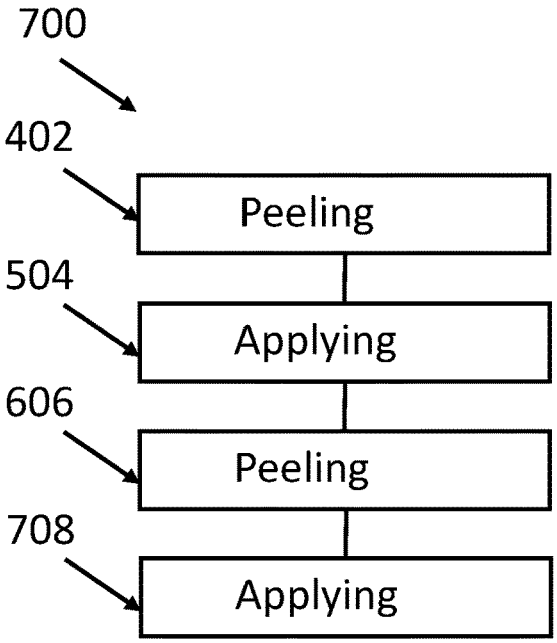
FIG. 7 illustrates yet another example method.

FIG. 7 illustrates an example method 700 comprising block 402 as described in the context of FIG. 4, block 504 as described in the context of FIG. 5, block 606 as described in the context of FIG. 6, as well as block 708 of applying a second clean film onto the portion of the inner surface of the second end cap in response to having peeled the second soiled film off as per block 606.

Such example methods, applicable to example end caps hereby described, permit recycling of end caps and can further permit protecting end caps from printing fluid accumulation during operation.

What is claimed is:

1. An end cap system for a developer unit in a liquid photographic printer, the end cap system comprising an end cap and a film, the film comprising:

a first outermost superficial layer; and a second outermost superficial layer opposed to the first outermost superficial layer, whereby the film comprises a cutout, whereby the first outermost superficial layer is a pressure sensitive adhesive layer applied to a portion of an inner surface of the end cap, and whereby the second outermost superficial layer is a low surface energy layer to be exposed to liquid photographic printing fluid during printing.

2. The end cap system according to claim 1, whereby the portion of the inner surface of the end cap to which the pressure sensitive layer is applied corresponds to at least 30% of an entire inner surface of the end cap.

3. The end cap system according to claim 1, whereby the film comprises a single film section.

4. The end cap system according to claim 1, whereby the film comprises more than one film section.

5. The end cap system according to claim 1, whereby the end cap includes a hole to permit supporting a shaft end of a roller of the liquid photographic printer.

6. The end cap system according to claim 1, whereby the inner surface of the end cap comprises an intricate edge, whereby the intricate edge is uncovered by the film.

7. The end cap system according to claim 1, whereby the low surface energy layer comprises a silicone polymer.

8. The end cap system according to claim 1, whereby the pressure sensitive adhesive layer comprises an epoxy-functional acrylic polymer.

9. The end cap system according to claim 1, whereby the film comprises a substrate layer between the first and the second outermost superficial layers.

10. The end cap system according to claim 9, whereby the substrate layer comprises a polyethylene terephthalate polymer.

11. The end cap system according to claim 1, whereby the film comprises a substrate layer between the first and the second outermost superficial layers, whereby the substrate layer comprises a polyethylene terephthalate polymer, whereby the low surface energy layer comprises a silicone polymer, and whereby the pressure sensitive adhesive layer comprises an epoxy-functional acrylic polymer.

12. A developer unit for a liquid electrophotographic printer, comprising:

a developer roller to present printing fluid to a photoconductor, the developer roller rotatable on a shaft;

a squeegee roller to squeegee printing fluid on the developer roller at an upstream nip between the developer roller and the squeegee roller, the squeegee roller rotatable on a shaft;

a cleaner roller to clean printing fluid from the developer roller at a downstream nip between the developer roller and the cleaner roller, the cleaner roller rotatable on a shaft;

an end cap at each end of the developer roller, the squeegee roller, and the cleaner roller to support the rollers on their respective shafts;

seals compressed between each end cap and each end of the squeegee roller, of the cleaner roller and of the developer roller; and films comprising a pressure sensitive adhesive layer applied to a portion of an inner surface of each end cap, the films further comprising a low surface energy layer to be exposed to liquid photographic printing fluid during printing.

13. The developer unit of claim 12, whereby the portion of the inner surface of the end caps to which the pressure sensitive adhesive layer is applied is separate from a part of the inner surface of the end caps against which the seals are compressed.

14. The developer unit of claim 12, the developer unit comprising a housing, the end caps being attached to the housing, an inner surface of the housing comprising a sprayed low surface energy additive.

15. The developer unit of claim 12, the developer unit comprising a top section comprising the developer roller, the squeegee roller, and the cleaner roller and a bottom section to collect printing fluid, whereby the portions of the inner surface of each end cap to which the films are applied correspond to the bottom section.

16. The developer unit of claim 12, the developer unit comprising electrodes, the films comprising a film section located between the electrodes.

17. An end cap for a developer unit in a liquid photographic printer, comprising:

a removable film that includes a plurality of film sections, wherein the removable film comprises:

a first outermost superficial layer; and a second outermost superficial layer opposed to the first outermost superficial layer, whereby the first outermost superficial layer is a pressure sensitive adhesive layer applied to a portion of an inner surface of the end cap, and whereby the second outermost superficial layer is a low surface energy layer to be exposed to liquid photographic printing fluid during printing.

18. The end cap of claim 17, wherein an inner surface of the removable film is directly exposed to the liquid photographic printing fluid.

19. The end cap of claim 17, wherein the second outermost superficial layer has a surface energy below 0.036 Newton per meter (N/m).

20. The end cap of claim 17, wherein the portion of the inner surface of the end cap is an intricate edge of the end cap.

* * * * *